US005179412A

United States Patent [19]

Yamada et al.

[11] Patent Number: 5,179,412

[45] Date of Patent: Jan. 12, 1993

[54] TRANSFER UNIT FOR XEROGRAPHIC PRINTING MACHINE WITH CONSTANT VENTILATING INTERIOR

[75] Inventors: Masato Yamada; Junji Shirakawa; Kazuo Uno; Kimio Nakamura, all of Ibaraki, Japan

[73] Assignee: Hitachi Koki Co., Ltd., Tokyo, Japan

[21] Appl. No.: 789,887

[22] Filed: Nov. 12, 1991

[30] Foreign Application Priority Data

Nov. 22, 1990 [JP] Japan ..... 2-319472

[51] Int. Cl.[5] ..... G03G 15/16; G03G 21/00

[52] U.S. Cl. ..... 355/215; 355/274

[58] Field of Search ..... 355/271, 273, 274, 275, 355/312, 215, 221

[56] References Cited

U.S. PATENT DOCUMENTS 5,005,051 4/1991 Haruki et al. ..... 355/215 X

FOREIGN PATENT DOCUMENTS 61-67051 4/1986 Japan ..... 355/215

63-85671 4/1988 Japan ..... 355/275

*Primary Examiner*—Joan H. Pendegrass

*Attorney, Agent, or Firm*—Sughrue, Mion, Zinn, Macpeak & Seas

[57] ABSTRACT

A transfer unit for a xerographic printing machine including at least two rollers and an endless belt supported by the rollers. A frame member supports the rollers. A photoreceptor is disposed adjacent to the endless belt, and a charging means is disposed opposite to the photoreceptor so that the endless belt is locate between the charging means and the photoreceptor. Pressure in the space within the transfer unit, which is surrounded by the endless belt and the frame member and contains the endless belt charging means disposed therein, is slightly higher than atmosphere pressure outside the transfer unit.

7 Claims, 2 Drawing Sheets

TRANSFER UNIT FOR XEROGRAPHIC PRINTING MACHINE WITH CONSTANT VENTILATING INTERIOR

BACKGROUND OF THE INVENTION

1. Field of the Invention

The present invention relates to a xerographic printing machine, and more particularly, to improvements of a transfer unit for a xerographic printing machine.

2. Description of the Related Art

In conventional xerographic printing machines, a transfer system based on corona discharge has been used for transferring a toner image formed on a photoreceptor to a print media. This type of transfer system is disadvantageous in that under high humidity conditions, image transfer performance is poor due to dust that accumulates on the corona wire and/or corrugations of the print media. To cope with this, a corona discharge transfer system in which the print media is pressed against a photoreceptor through a belt made of material of which the volume resistance is $10^9$ to $10^{14}$ Ωcm, has been proposed. In such a transfer system, the transfer performance varies largely due to a change of the electrical characteristics of the belt.

FIG. 4 is a sectional view showing the construction of a transfer unit for a conventional xerographic printing machine. FIG. 5 is a longitudinal sectional view of a charging unit used in the machine of FIG. 4. Endless belt 1 is stretched and wound, at a preset tensile force, around drive roller 2 and follower rollers 3, 4, and 5, so as to press paper 15 against photoreceptor 8. To secure a normal image transfer, the surface potential of the belt must be kept at a proper value. Ionic materials produced during the corona discharge by charging unit 14, dust in the air, toner, and the like, are attracted to, and deposited on, the surface of endless belt 1. As a result, the electrical resistance and dielectric constant of endless belt 1 change with time. This leads to a decrease in the surface electrical potential of the belt. As a result, the quantity of charge transferred to the print media changes, and hence the image transfer performance changes.

To cope with these limitations, conventional machines use suction means 9, provided near charging unit 14, to exhaust gases, such as $O_3$ and Nox. The result is to create a negative pressure within transfer unit 7. With the negative pressure created, dust and toner, together with air, are introduced into the transfer unit, so as to soil the reverse side of endless belt 1. To prevent contamination by foreign materials, the conventional machine seals the gap between endless belt 1 and the frame. The sealing diminishes the gas vacuum action by suction means 9. Accordingly, endless belt 1 must still be replaced with a new one frequently.

SUMMARY OF THE INVENTION

The present invention has been made in view of the above circumstances and has an object to provide a xerographic printing machine which diminishes the change with time of the electrical characteristics of an endless belt.

Another object of the present invention is to provide a transfer unit for a xerographic printing machine, which constantly ventilates the interior of the transfer unit and prevents foreign materials from entering the interior of the transfer unit.

The invention is a xerographic printing machine having a transfer unit that includes at least two rollers having axes of rotation that are parallel to each other. An endless belt is supported by the rollers and a frame member. A photoreceptor is disposed adjacent to the endless belt, a charging means is disposed opposite to the photoreceptor so that the endless belt is located between the charging means and the photoreceptor. Pressure in the space within the transfer unit, which is surrounded by the endless belt and the frame member and contains the endless belt charging means disposed therein, is slightly higher than atmospheric pressure outside the transfer unit.

Air is sent to the interior of the transfer unit by a blower provided outside the transfer unit or on the outer walls of the frame member.

Since the pressure within the transfer unit is higher than atmospheric pressure, air, $O_3$ and Nox are forcibly exhausted out of the transfer unit through gaps between the endless belt and the frame. As a result, the inside of the transfer unit is ventilated and foreign materials will not enter the transfer unit.

Other objects, features and advantages of the invention will be apparent when carefully reading the detailed description to follow in connection with the accompanying drawings.

DETAILED DESCRIPTION OF THE PREFERRED EMBODIMENTS

Figure 1:
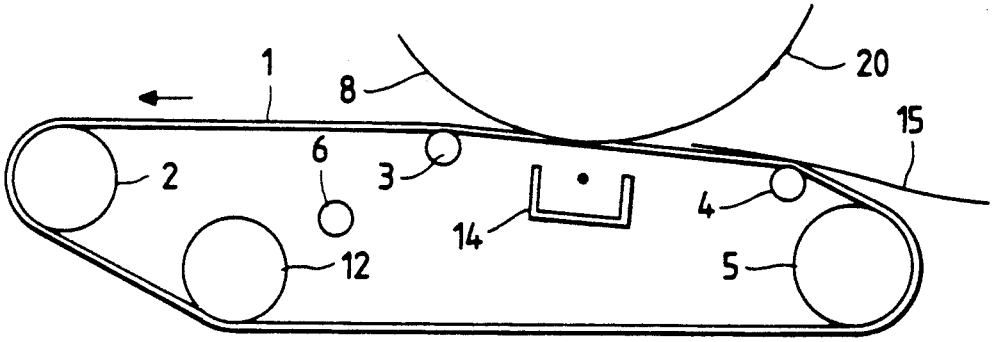
FIG. 1 is a sectional view showing a transfer unit for a xerographic printing machine according to an embodiment of the present invention.
Figure 2:
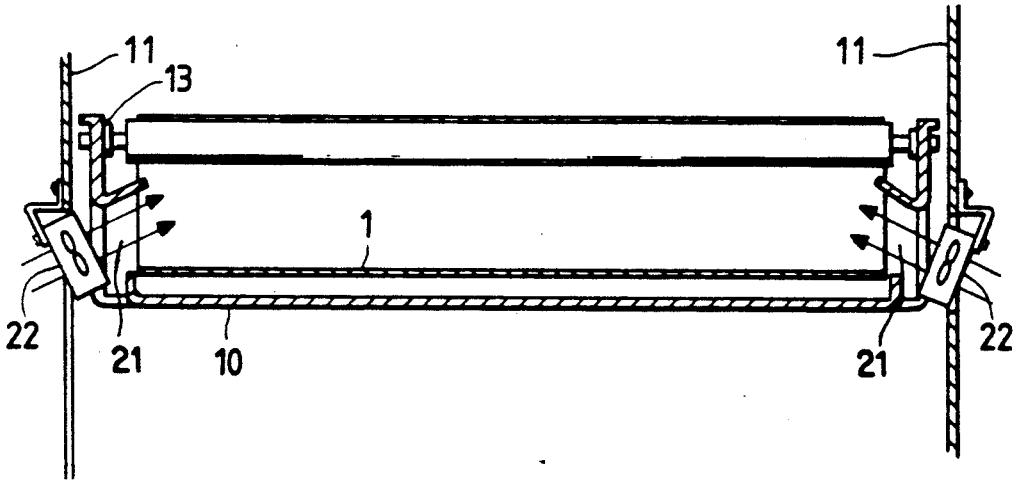
FIG. 2 is a longitudinal sectional view showing of a charging unit used in the machine of FIG. 1.
Figure 3:
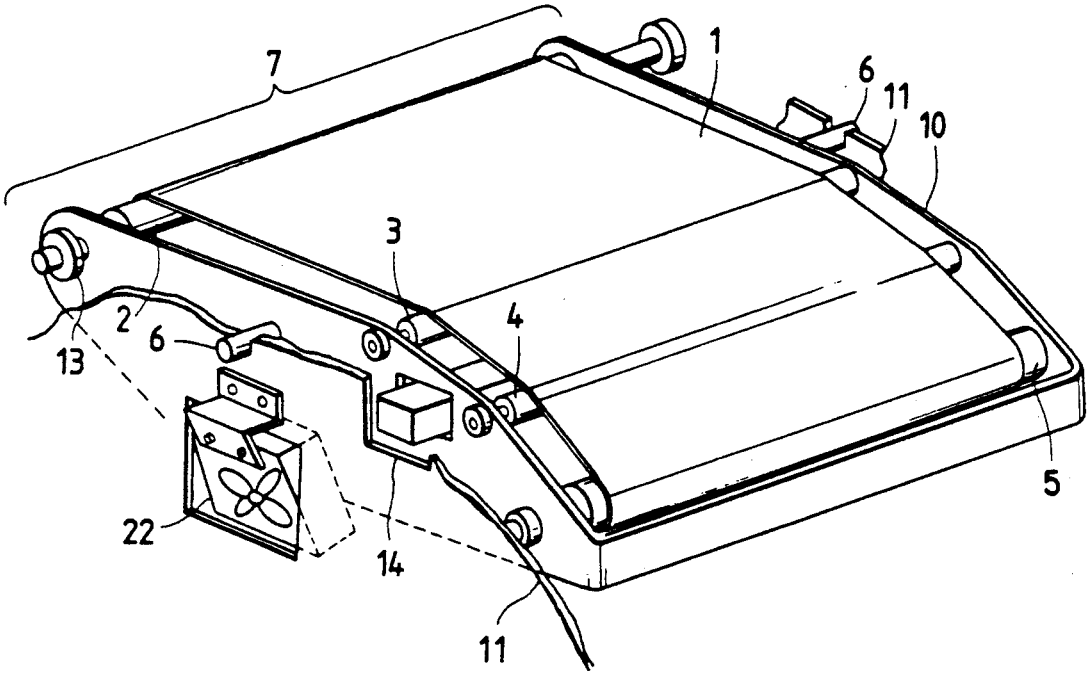
FIG. 3 is a perspective view showing the transfer unit of FIG. 1.
Figure 4:
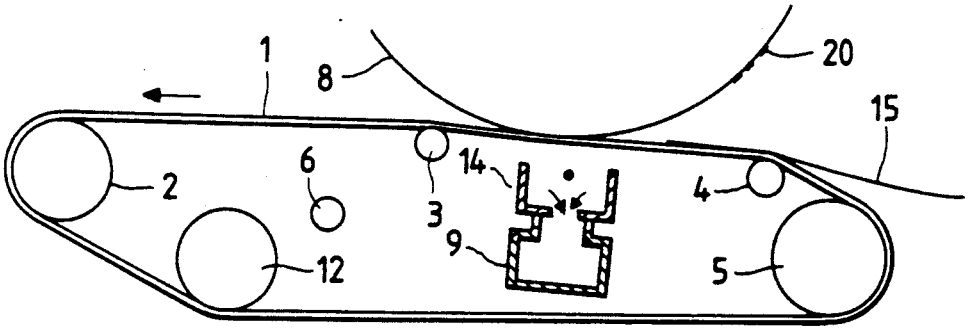
FIG. 4 PRIOR ART
FIG. 4 is a sectional view showing the construction of a transfer unit for a conventional xerographic printing machine.
Figure 5:
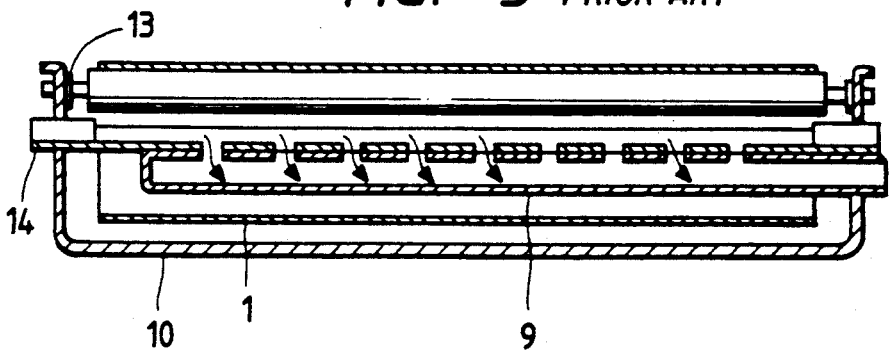
FIG. 5 PRIOR ART
FIG. 5 is a longitudinal sectional view of a charging unit used in the machine of FIG. 4.

FIG. 1 is a sectional view showing the construction of a transfer unit for a xerographic printing machine according to an embodiment of the present invention. FIG. 2 is a longitudinal sectional view of a charging unit used in the machine of FIG. 1. FIG. 3 is a perspective view showing the transfer unit of FIG. 1. In FIG. 3, endless belt 1 is supported by drive roller 2 and follower rollers 3, 4, 5, and 12. Drive roller 2 is rotatably mounted to frame 10 by means of bearings 13. These components cooperate to constitute transfer unit 7.

Transfer unit 7 is rotatably mounted to mechanical frame 11 by shaft 6. Thus, transfer unit 7 is rotatable about shaft 6, and is driven by a driving unit (not shown). When driven by the driving unit, transfer unit 7 turns to bring endless belt 1 into contact with photoreceptor 8 or to detach the photoreceptor 8 therefrom, depending on the turn direction of the unit (see FIG. 1).

Charge means 14 is disposed opposite to photoreceptor 8 so as to place endless belt 1 therebetween. The side walls of frame 10 of transfer unit 7 are opened to form openings 21 (see FIG. 2). blowing means 22, such as blowers, are provided so as to force air into the interior of transfer unit 7, through openings 21. In this embodiment, blowing means 22 is mounted on the side walls of frame 10. If required, blowing means 22 may be disposed outside of transfer unit 7.

Charging unit 14 generates $O_3$ and Nox, so that the space within transfer unit 7 is filled with these gases. When blowing means 22 sends air into transfer unit 7, the pressure within transfer unit 7 rises slightly, and air, $O_3$ and Nox are forcibly exhausted out of transfer unit 7 through gaps between endless belt 1 and frame 10. The result is to ventilate the inside of transfer unit 7 and also to prevent foreign materials from entering the inside of transfer unit 7.

As described above, transfer unit 7 of the invention can exhaust gases, such as $O_3$ and Nox, generated during the corona discharge, and at the same time prevent foreign materials, such as dust and toner, from entering the inside thereof. With the above-mentioned beneficial features, the change of the electrical characteristics of endless belt 1, due to aging, can be reduced. Therefore, the xerographic printing machine can maintain a stable transfer performance over a long time.

While there has been described what is at present considered to be the preferred embodiment of the invention, it will be understood by those skilled in the art that the foregoing and other changes in form and details can be made therein without departing from the spirit and scope of the invention.

What is claimed is:

1. A xerographic printing machine comprising:

a transfer unit including at least two rollers having rotational axes that are parallel to each other, an endless belt supported by said rollers and a frame member for supporting said rollers;

a photoreceptor disposed adjacent to said endless belt;

means for placing an electrical charge on said belt, where said electrical charge means is disposed opposite to said photoreceptor so as to place said endless belt therebetween; and means for blowing air in a space defined by said endless belt and said frame member and creating a pressure in said space which is higher than an atmospheric pressure outside said transfer unit, said blowing means being provided outside said transfer unit.

2. The xerographic printing machine according to claim 1, wherein said blowing means is disposed on outer walls of said frame member.

3. A xerographic printing machine, comprising:

a transfer unit including at least two rollers having rotational axes that are arranged parallel to each other, an endless belt supported by said rollers and a frame member for supporting said rollers, said frame member including at least one side wall with an opening formed therein;

a photoreceptor disposed adjacent to said endless belt;

electrical charge means for placing an electrical charge on said endless belt disposed opposite to said photoreceptor so as to place said endless belt therebetween; and at least one means for blowing air into an interior of said transfer unit, through said opening formed in said side wall to create pressure in said interior which is higher than an atmospheric pressure outside said transfer unit.

4. The xerographic printing machine according to claim 3, wherein said blowing means is disposed outside of the transfer unit.

5. The xerographic printing machine according to claim 3, wherein said blowing means is disposed on an outer wall of the frame member.

6. A xerographic printing machine comprising:

a transfer unit including at least two rollers having rotational axes that are parallel to each other, an endless belt supported by said rollers and a frame member for supporting said rollers;

a photoreceptor disposed adjacent to said endless belt;

means for placing an electrical charge on said belt, where said electrical charge means is disposed opposite to said photoreceptor so as to place said endless belt therebetween; and means for blowing air in a space defined by said endless belt and said frame member and creating a pressure in said space which is higher than an atmospheric pressure outside said transfer unit, said blowing means being provided outside said transfer unit and disposed on outer walls of said frame member.

7. A xerographic printing machine, comprising:

a transfer unit including at least two rollers having rotational axes that are arranged parallel to each other, an endless belt supported by said rollers and a frame member for supporting said rollers, said frame member including at least one side wall with an opening formed therein;

a photoreceptor disposed adjacent to said endless belt;

electrical charge means for placing an electrical charge on said endless belt disposed opposite to said photoreceptor so as to place said endless belt therebetween; and at least one means for blowing air into an interior of said transfer unit, through said opening formed in said side wall to create a pressure in said interior which is higher than an atmospheric pressure outside said transfer unit, said at least one blowing means being provided outside said transfer unit and disposed on an outer wall of said frame.

* * * * *